US005191751A

United States Patent [19]

Marzullo et al.

[11] Patent Number: 5,191,751

[45] Date of Patent: Mar. 9, 1993

[54] ENVELOPE OPENING APPARATUS

[75] Inventors: Joseph H. Marzullo, Brookfield; Sandra J. Graveson, Waterbury; Michael D. Ballard, Sandy Hook; Curtis L. Mrozinski, Redding, all of Conn.

[73] Assignee: Pitney Bowes Inc., Stamford, Conn.

[21] Appl. No.: 646,482

[22] Filed: Jan. 25, 1991

Related U.S. Application Data

[63] Continuation of Ser. No. 438,029, Nov. 20, 1989, abandoned.

[51] Int. Cl.[5] ..... B65B 43/26

[52] U.S. Cl. ..... 53/569; 53/381.7

[58] Field of Search ..... 53/247, 284.3, 381.5, 53/381.6, 381.7, 460, 569, 530, 570

[56] References Cited

U.S. PATENT DOCUMENTS

| | | | |
|---|---|---|---|
| 2,771,726 | 11/1956 | Owen et al. | 53/266 A X |
| 3,292,340 | 12/1966 | Smith et al. | 53/569 X |
| 3,568,401 | 3/1971 | Bonsch | 53/266 A X |
| 3,894,905 | 7/1975 | Ehlscheid | 53/460 X |
| 3,936,993 | 2/1976 | Dorer | 53/569 X |
| 4,169,341 | 10/1979 | Roetter et al. | 53/266 A X |
| 4,205,506 | 6/1980 | Moens et al. | 53/569 |
| 4,337,609 | 7/1982 | Foster et al. | 53/266 A X |
| 4,633,644 | 1/1987 | Haroutel et al. | 53/266 A X |
| 4,852,334 | 8/1989 | Auerbach | 53/266 A X |
| 4,864,800 | 9/1989 | Banys et al. | 53/570 X |

*Primary Examiner*—John Sipos
*Assistant Examiner*—Linda B. Johnson
*Attorney, Agent, or Firm*—Charles R. Malandra, Jr.; David E. Pitchenik; Melvin J. Scolnick

[57] ABSTRACT

Apparatus for inserting one or more documents into a waiting envelope. The apparatus includes: a supporting frame; a device mounted in the frame for holding the envelope; a movable, endless belt rotatably mounted in the frame for transporting one or more documents into the waiting envelope; and a datum guide plate secured to the frame above the movable belt. The movable belt includes an upper reach which is biased toward the datum guide plate.

7 Claims, 7 Drawing Sheets

ENVELOPE OPENING APPARATUS

This application is a continuation of application Ser. No. 438,029, filed Nov. 20, 1989 now abandoned.

BACKGROUND OF THE INVENTION

The instant invention relates to apparatus for inserting sheet materials into envelopes, and more particularly to such apparatus capable of accommodating a variety of thicknesses of such materials.

Envelope stuffing machines, such as those shown in U.S. Pat. Nos. 4,169,341 and 4,337,609, both assigned to the assignee of the instant application, generally include: a conventional structure for delivering an envelope, with its address panel oriented upwardly and its flap opened, to a registration gate at an enclosure inserting station; conventional structure for timely opening the delivered envelope, including a plurality of fingers known in the art as stripper fingers, which are insertable into the throat of the envelope for opening the same; and conventional structure for inserting an enclosure into the opened envelope. Typically, the envelope opening structure includes a plate which acts as a ledge upon which the flap of the envelope is located when it is delivered to the inserting station. Moreover, one or more rigid finger members, known in the art as depressor fingers, are fixedly attached to the framework of the inserter apparatus and disposed in overhanging relationship with respect to the envelope's address panel, for depressing the body of the envelope downwardly against the resistance afforded by the envelope flap ledge to thereby partially open the throat of the envelope to facilitate insertion of the stripper fingers into the envelope.

Operators of the conventional inserters have experienced difficulties with them due to the aforesaid fixed depressor fingers tending to prevent delivery of the envelope to the registration gate. As a result, many operators have been bending the depressor fingers away from the path of travel of the envelope to ensure delivery to the registration gate, as a result of which the force exerted on the envelope by the depressor fingers is reduced and the envelope is insufficiently depressed to permit entry of the stripper fingers into the envelope for opening the same. Accordingly, misfeeds resulting from improper envelope registration and failure to open the envelopes have been found to be directly attributable to the provision of the fixed depressor fingers. The aforesaid U.S. Pat. No. 4,337,609 taught a partial solution to the problems generated by fixed depressor fingers by providing movable depressor fingers which normally hold the depressor fingers out of the path of travel of the envelope and for moving the depressor fingers into engagement with the envelope when a connective solenoid is enabled.

However, problems continued to persist using the movable depressor fingers. Accordingly, in U.S. Pat. No. 4,852,334 issued Aug. 1, 1989, the assignee of the instant invention provided an envelope opening apparatus which employs only a pair of orbital stripper claws and does not require the use of any depressor fingers, fixed or movable, and the substantial amount of apparatus associated therewith.

The aforesaid '334 patented inserting apparatus, unfortunately, suffers from a shortcoming inherent in virtually all inserters, i.e. an inability to reliably and consistently insert a variety of thickness of enclosures into envelopes. Therefore, the instant invention provides apparatus which assures that regardless of the thickness of a collation of enclosures, that the collation can be reliably and consistently inserted into the waiting envelopes.

SUMMARY OF THE INVENTION

Accordingly, the instant invention provides apparatus for inserting one or more documents into a waiting envelope. The apparatus includes: a supporting frame; means mounted in the frame for holding the envelope; a movable, endless belt rotatably mounted in the frame for transporting said one or more documents into the waiting envelope; and a datum guide plate secured to the frame above the movable belt. The movable belt includes an upper reach which is biased toward the datum guide plate.

BRIEF DESCRIPTION OF THE DRAWINGS

FIG. 5 is a sectional view taken on the plane indicated by the line 5—5 in FIG. 4;

DESCRIPTION OF THE PREFERRED EMBODIMENT

Figure 1:
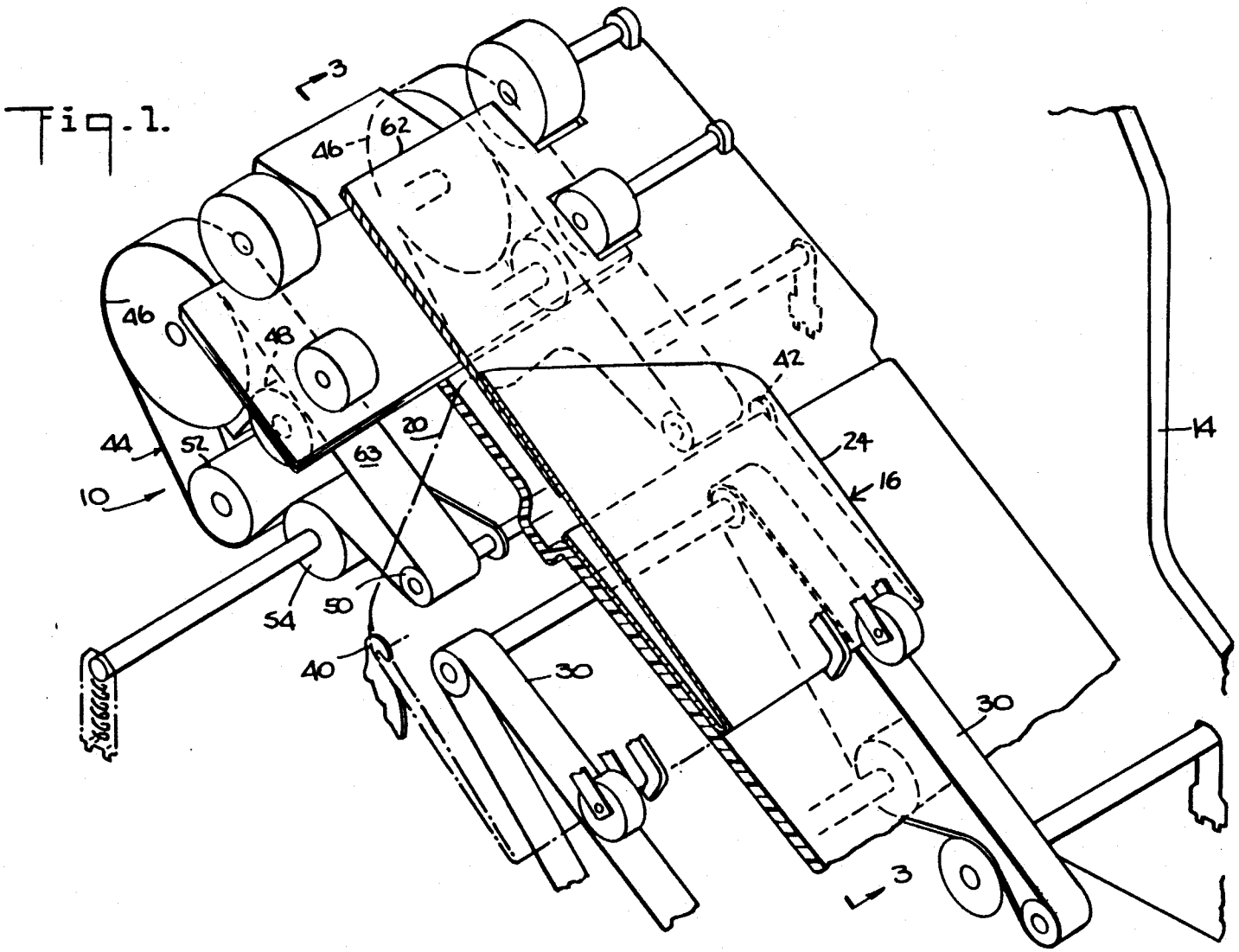
FIG. 1 is a perspective view of an envelope inserting apparatus incorporating a floating, lower belt in accordance with the instant invention, and showing an envelope in the inserting position.
Figure 2:
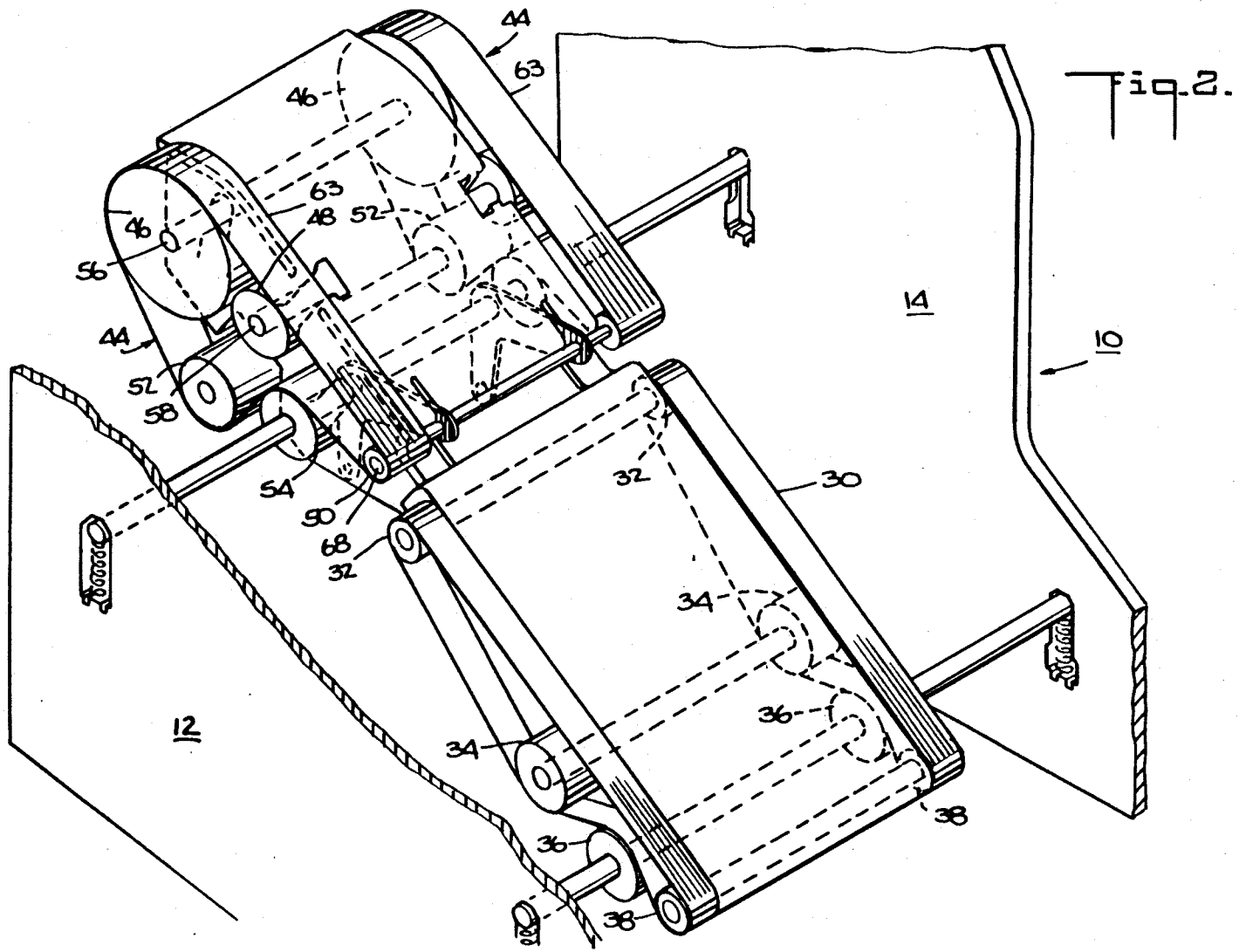
FIG. 2 is a perspective view similar to FIG. 1 but without the datum guide plate.

In describing the preferred embodiment of the instant invention, reference is made to the drawings wherein there is seen an envelope inserting machine generally designated 10 having a pair of sidewalls 12 and 14. The inserter 10 includes a storage bin (not shown) for a stack of envelopes 16 and one or more hoppers (not shown) for storing one or more insert documents 18.

Figure 3:
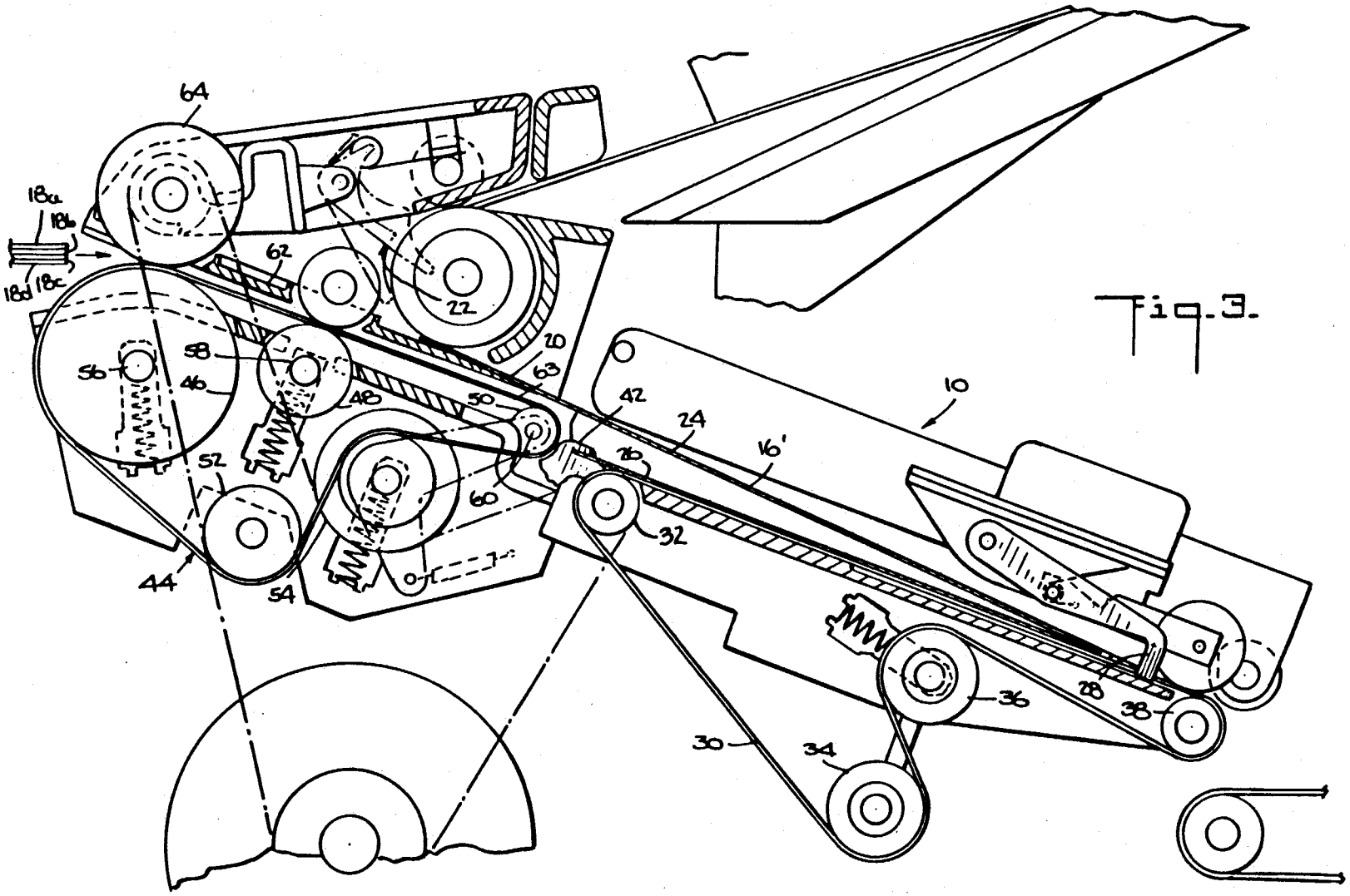
FIG. 3 is a sectional view taken on the plane indicated by the line 3—3 in FIG. 1, and shows a collation of documents being transported into a waiting envelope.
Figure 4:
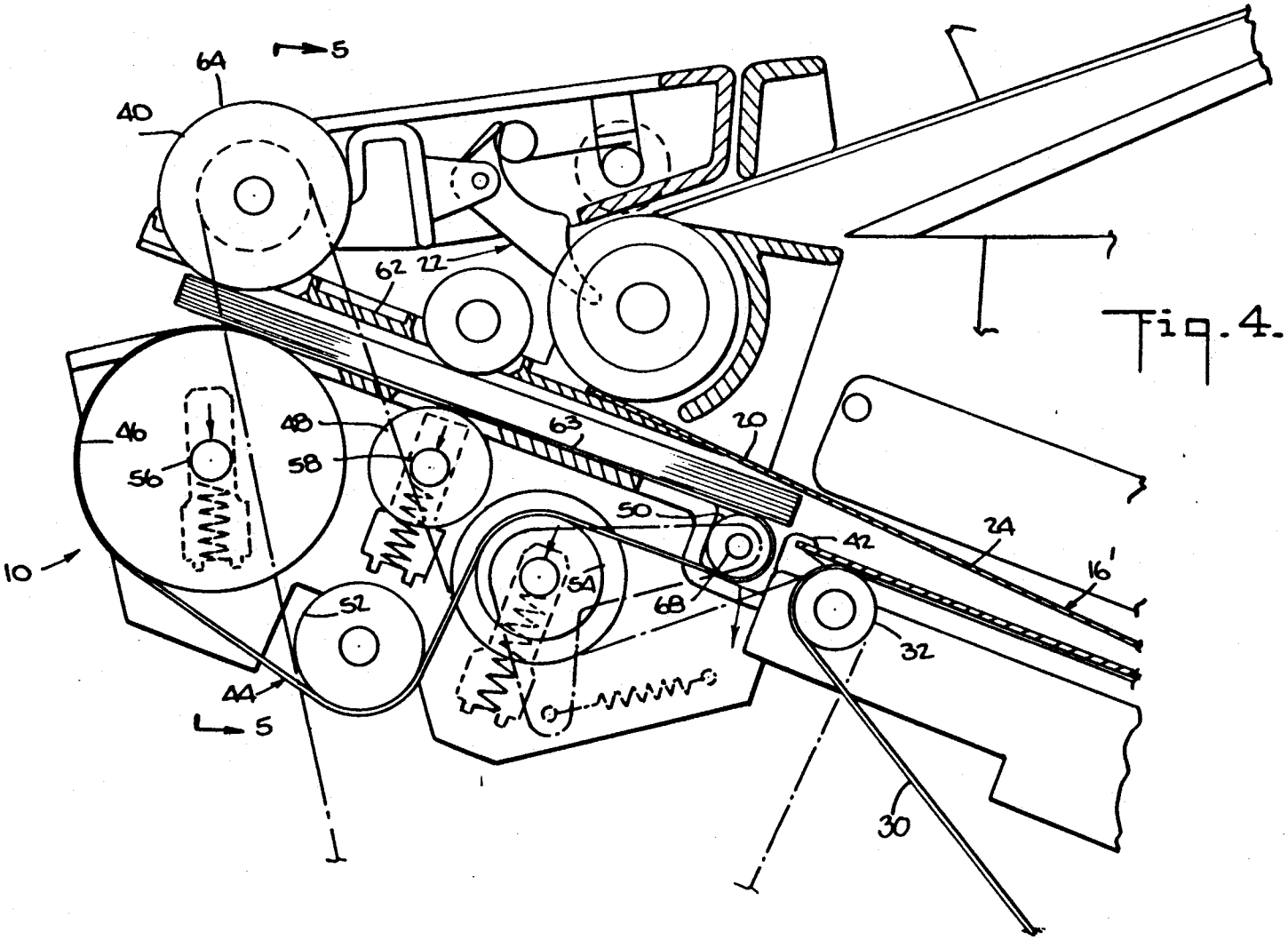
FIG. 4 is similar to FIG. 3 but shows a collation of documents being inserted into a waiting envelope.
Figure 8:
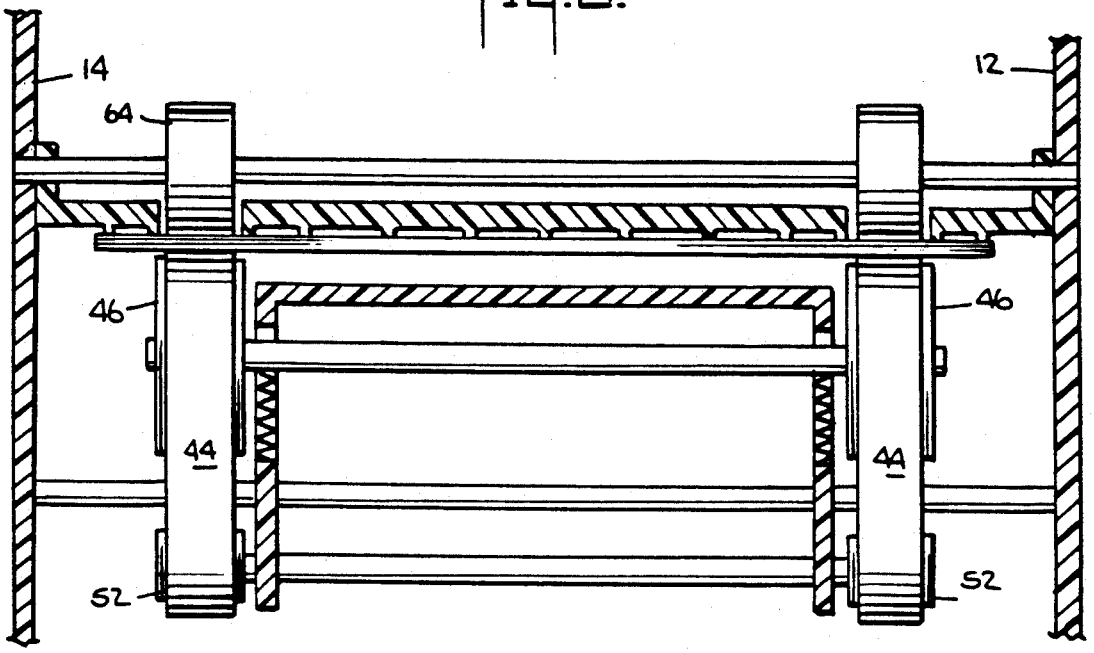
FIG. 8 is the same as FIG. 5 except that the collation is thinner than in FIG. 5.
Figure 9:
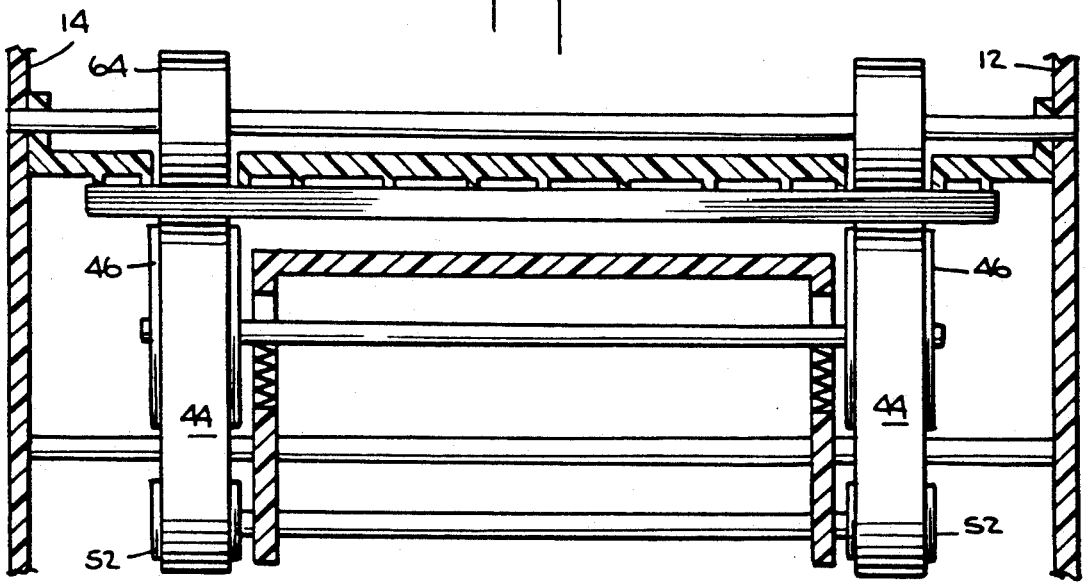
Figure 6:
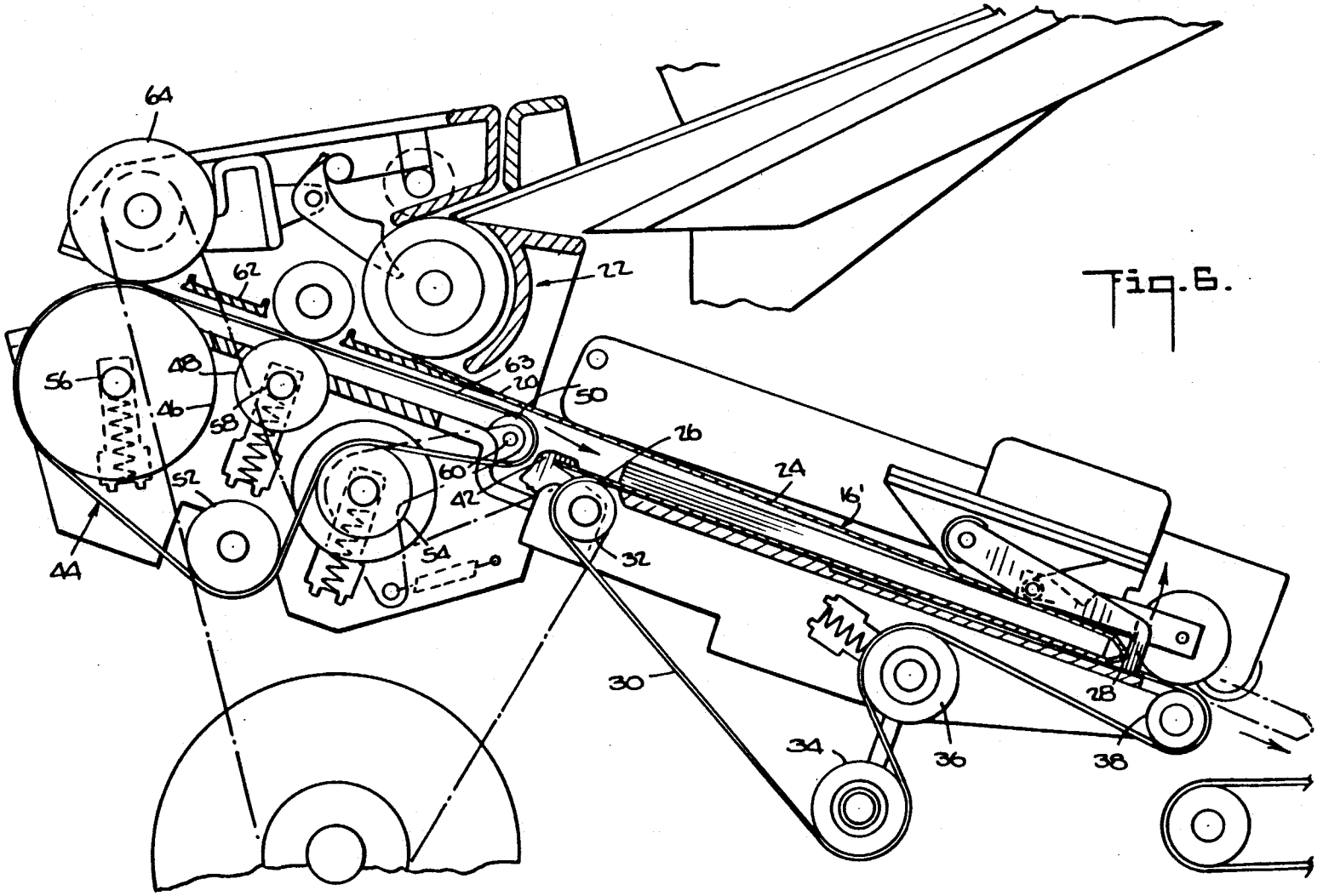
FIG. 6 is similar to FIGS. 3 and 4 but shows the collation of documents having been inserted into the envelope.
Figure 7:
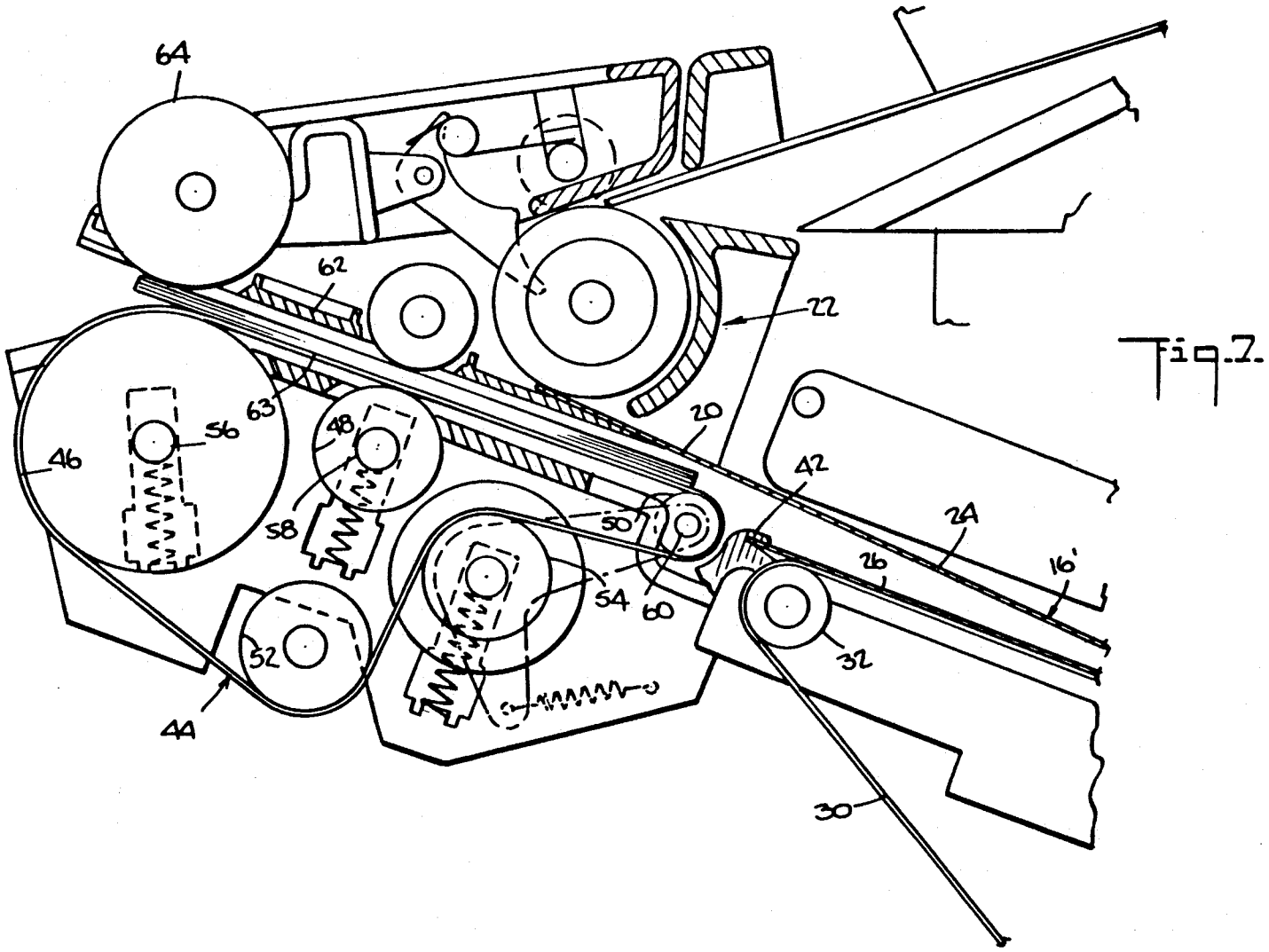
FIG. 7 is similar to FIG. 4 but shows a thinner collation than seen in FIG. 4 being inserted into the waiting envelope.

The envelopes 16 include the usual flap 20 which is bent or folded back on the envelope 16 when the envelope 16 is located in the storage bin. Accordingly, an envelope flap stripper generally designated 22, which is well known in the art and does not require further explanation, is provided in order to separate the flap 20 from the long wall 24 and the short wall 26 of the envelope 16, so that the envelope 16 can assume the open position of envelope 16' seen in FIGS. 1, 4, 6 and 7 preparatory to receiving the collation of inserts 18 *a–d* seen in FIG. 3.

The envelope 16 is conveyed from the flap stripper 22 to a pivotable stop 28 (see FIGS. 3 and 6) by means of a pair of belts 30 which are trained over a plurality or pairs of rollers 32, 34, 36 and 38. Thereafter, a pair of arcuate claws 40 and 42 movable in an orbit are enabled to engage the envelope 16' and thereby open the envelope 16' to receive the inserts 18.

The inserts 18 are fed to the envelope 16' by means of a pair of floating, endless, drive belts 44 which are respectively trained over biased pair of rollers 46, 48 and 50 and a fourth pair of rollers 52 and a fifth pair of rollers 54.

The three pairs of rollers 46, 48 and 50 are mounted respectively on biased shafts 56, 58 and 60 which are biased in the direction of a datum guide plate 62. The upper reaches 63 of the belts 44 are thus biased upwardly toward the guide plate 62. A pair of idler rollers 64 cooperate with the drive belts 44 to feed the inserts 18 toward the waiting envelope 16'.

From the foregoing description, it can be understood that the top of a collation of inserts 18 will always be fed along the same plane defined by the datum guide plate 62. The envelope 16' is always presented straight and flat to the collation of inserts 18 without a throat pinch. Thus, the path of insertion for the inserts 18 into the envelope 16' is always straight into the envelope 16'. For thicker collations of inserts 18, the upper reaches 63 of the floating drive belts 44 give way so that the top of the collation is fed along the guide plate 62.

It should be clear that the inserting system described hereinabove provides a means for assuring that a collation of inserts can be reliably and consistently inserted into a waiting envelope regardless of the thickness of the collation.

It should be understood by those skilled in the art that various modifications may be made in the present invention without departing from the spirit and scope thereof, as described in the specification and defined in the appended claims.

What is claimed is:

1. Apparatus for inserting one or more documents into a waiting envelope having a flap, comprising:

a supporting frame;

means mounted in said frame for holding said envelope;

a movable, endless belt rotatably mounted in said frame for transporting said one or more documents into said waiting envelope; and a datum guide plate secured to said frame above said movable belt for holding open the flap of said envelope, and in cooperation with said movable belt for guiding said documents into said envelope; and means for biasing a reach of said movable belt toward said datum guide plate, wherein said documents are transported between said datum guide plate and said reach, said datum guide plate defining a plane along which said documents are fed into said envelope.

2. The apparatus of claim 1, additionally comprising a claw for opening said waiting envelope.

3. The apparatus of claim 1, additionally comprising a roller rotatably mounted on said frame for supporting said endless belt.

4. The apparatus of claim 1, wherein said holding means comprises a pivotable stop.

5. The apparatus of claim 1, wherein said movable belt is traversed over a plurality of biased rollers, whereby the entire upper reach of said movable belt is biased toward said datum guide plate.

6. The apparatus of claim 5, wherein each of said biased rollers is mounted on a shaft biased in the direction of said datum guide plate.

7. The apparatus of claim 2, wherein said datum guide plate supports a flap of said envelope as said claw opens said envelope.

* * * * *